United States Patent [19]

Coffindaffer et al.

[11] Patent Number: 5,062,971

[45] **Date of Patent: * Nov. 5, 1991**

[54] STARCH WITH SILICONE GEL FOR EASE OF IRONING AND IMPROVED FABRIC APPEARANCE AFTER IRONING

[75] Inventors: Timothy W. Coffindaffer, Loveland; Robert G. Bartolo, Cincinnati, both of Ohio; Kathleen A. Belfiore, Beaver Falls, Pa.

[73] Assignee: The Procter & Gamble Company, Cincinnati, Ohio

[ * ] Notice: The portion of the term of this patent subsequent to May 8, 2007 has been disclaimed.

[21] Appl. No.: 534,110

[22] Filed: Jun. 6, 1990

[51] Int. Cl.[5] ..... P06M 11/00; C11D 3/00

[52] U.S. Cl. ..... 252/8.6; 252/8.8; 252/8.9; 252/174.15; 528/38; 556/424; 556/425

[58] Field of Search ..... 252/8.6, 8.8, 8.9, 174.15; 528/38; 556/424, 425

[56] References Cited

U.S. PATENT DOCUMENTS 4,800,026 1/1989 Coffindaffer et al. ..... 252/8.8

4,923,623 5/1990 Coffindaffer ..... 252/8.8

*Primary Examiner*—Paul Lieberman

*Assistant Examiner*—Bradley A. Swope

*Attorney, Agent, or Firm*—Leonard Williamson; Robert B. Aylor; Richard C. Witte

[57] ABSTRACT

This invention relates to liquid starch containing compositions comprising a silicone gel for ease of ironing and improved appearance after ironing.

25 Claims, No Drawings

STARCH WITH SILICONE GEL FOR EASE OF IRONING AND IMPROVED FABRIC APPEARANCE AFTER IRONING

FIELD OF THE INVENTION

This invention relates to starch compositions and to a method for treating fabrics in order to improve various properties of the fabric, in particular, ease of ironing and improved appearance after ironing.

BACKGROUND OF THE INVENTION

In the modern world the vast majority of clothing is made from woven fabrics, and the art of weaving is many centuries old. Indeed the invention of weaving is generally attributed to the Ancient Egyptians. Yarns were produced from natural cotton, wool, or linen fibers, and garments made from fabrics woven from these yarns often creased badly in wear and, when washed, required considerable time and effort with a smoothing iron to restore them to a pristine appearance.

Within the last half century, textile manufacturers have implemented two major improvements in wash-and-wear garments: (1) the use of crosslinking resins on cotton containing garments, and (2) the use of synthetics and synthetic blends. Although these two implementations have made major strides in reducing the wrinkling of a garment, consumers are still dissatisfied with the results and feel a need to iron.

The term "ease of ironing and improved appearance after ironing" as used herein means that a fabric requires less effort to iron (i.e., improved glide of the iron and wrinkles are removed more easily) and has less wrinkles after a special cleaning operation followed by ironing than it would otherwise have after an ordinary cleaning operation and ironing.

Starch has been used for many years in fabric treatment to restore and retain them in a pristine appearance.

SUMMARY OF THE INVENTION

This invention relates to starch compositions comprising a silicone gel agent for ease of ironing and improved appearance after ironing. It is therefore, an object of the present invention to provide some liquid starch compositions containing silicone gels which improve ease of ironing and the appearance after ironing of the treated garments. This and other objects are obtained herein, and will be seen from the following disclosure.

DETAILED DESCRIPTION OF THE INVENTION

This invention relates to liquid starch compositions comprising silicone gels for ease of ironing and improved appearance after ironing. In another respect this invention relates to methods of using such silicone gel compositions in the treatment of fabrics for improved ease of ironing and improved appearance after ironing. Preferred compositions are liquids which are sprayed onto or rinsed into the laundered fabrics. These preferred compositions are aqueous starch based liquids which contain from about 0.1% to about 33%, more preferably from about 0.5% to about 20% of the curable amine functional silicone. The more concentrated compositions can be diluted in a rinse. The lesser concentrated compositions are sprayed directly onto fabric. Surprisingly, the silicone gels plus a suitable carrier to deposit an effective amount of the silicone gel on fabric are excellent for ease of ironing and improved appearance after ironing. Accordingly, several fabric care compositions containing silicone gels are herein disclosed. Several methods of using silicone gels for ease of ironing and improved appearance after ironing are also disclosed.

The silicone gel compositions of this invention are used with a suitable carrier. The term "carrier" as used herein means any suitable vehicle that is used to deliver the silicone gel and deposit it on the fabric.

This invention comprises a liquid starch composition comprising the silicone gel plus starch and a suitable carrier.

In a preferred execution, about 0.1% to about 10% by weight of an emulsified silicone gel is mixed into a suitable commercially available pump spray starch composition. The result is a spray starch composition that provides an improved ease of ironing and improved appearance after ironing to fabric sprayed therewith. Suitable commercially available spray starch compositions are based on water and a suitable emulsifier. Care must be taken to use silicone gel emulsifiers which are compatible with the starch and the silicone gel to avoid deemulsification. A second execution includes a laundry rinse wherein the level of silicone gel is present in the rinse water at about 1–300 ppm, preferably about 5–150 ppm.

Preferably, care should be taken to insure that the compositions of the present invention are essentially free of heavy waxes, abrasives, fiberglass, and other fabric incompatibles.

Silicone Gels

Silicone gels are somewhat of a cross between silicone fluids and silicone resins. Silicone fluids are by definition flowable silicone polymers of varying viscosities that can be branched or linear. Where typically, silicone resins are highly crosslinked siloxane solid systems with the crosslinking components introduced as tri-functional (T) (e.g., $RSiO_{1.5}$), or tetra-functional units (Q) (e. g., $SiO_2$). As one increases the tri- or tetra-functional units without increasing the mono-functional or terminal component (M) (e.g., $R_3SiO_{0.5}$), the resin becomes more brittle.

Most importantly for this invention, as one increases the di-functional units (D) (e.g., $R_2SiO$), the resin becomes softer and eventually is considered a silicone gel. In addition to the influence of mono-, tri-, tetra-, and di-functional units on the silicone resins and gels, their characteristics can also be influenced by changing the organic group. While not being too limiting, typical silicone resins and gels use methyl, phenyl, vinyl, and mixtures thereof as the organic groups. Other possible groups, but not limiting, include amines (primary, secondary, tertiary, quaternary, cyclic, diamines and triamines), epoxides, esters, ethers, halo functional organics, carboxy, and even hydrogen.

The silicone gel important for this invention is very soft as compared to resins and has a lower level of crosslinking (i.e., a lower level of tri- (T) and/or tetra- (Q) functional units) as compared to silicone resins. The silicone gel of this invention also has a higher level of crosslinking as compared to a silicone fluid or a viscous silicone gum. The terms Q, tetra-, and quat- as used herein are synonymous. More specifically, a preferred silicone gel has from about 3% to about 30% T and/or Q functional units, from about 70% to about 97% D functional units, and from 0% to about 10% M functional units; preferably, the silicone gel has from about 5% to about 20% T and/or Q functional units, from about 80% to about 95% D functional units, and from 0% to about 8% M functional units. More preferably, the silicone gel has from about 5% to about 15% T and/or Q functional units, from about 85% to about 95% D functional units, and from 0% to about 5% M functional units. The polymeric silicone gel should have a molecular weight greater than about 20,000; greater than about 50,000; even greater than about 100,000; The molecular weight of the silicone gel can be greater than about 500,000 ±400,000, and even greater than about 1,000,000. The important factor is that the silicone is a gel. The higher the level of the T and/or Q functional units, the lower the molecular weight of the gel.

In addition, the silicone gel must be in a form in which it can be delivered to the laundered fabric, preferably via an aqueous vehicle; thus an emulsified form is very desirable. While not limiting the emulsification of a preformed gel, the generation of the silicone gel itself in an emulsion is a preferred method of making the preferred embodiment of this invention.

This can be accomplished by many different methods. Two general methods are: (1) emulsion polymerization (see U.S. Pat. No. 4,600,436, Traver/Thimineur/Zotto, issued July 15, 1986, for Durable Silicone Emulsion Polish, incorporated herein by reference, particularly col. 6, 11. 35-47); and (2) emulsification of polymers followed by curing in the emulsion (see "Silicones," by Hardman et al., *Encyclopedia of Polymer Science and Engineering*, Vol. 15, Second Edition, pages 204-308, John Wiley and Sons, Inc., 1989, also incorporated herein by reference). There are four methods of curing set out in Harding et al.: (1) condensation; (2) peroxide; (3) platinum-catalyzed hydrosilation; and (4) Uv. These curing methods are known in the art, however, one must take care in picking the starting materials and reaction conditions to insure obtaining the desired "gel."

One specific method of the generation of a gel is to first emulsify a curable branched silicone polymer, then cure the polymer to a gel within the emulsion droplet before delivering to the fabric. For example: an emulsified branched curable amine functional silicone (experimental emulsion supplied by General Electric Co., No. 124-7701, which is a 20% emulsion of a GE commercially available curable amine functional silicone, sold under the trade name SF 1706) at a pH of 9 to 10 heated at 50° C. in a glass container for 5 to 10 days yields an emulsified silicone gel.

The silicone gel is made from a branched curable amine functional silicone having the following structure:

$$((RO)R'_2\,SiO_{1/2})_X(R'_2\,SiO_{2/2})_Y(R''\,SiO_{3/2})_Z,$$

wherein X is equal to Z+2; and Y is at least 3; and wherein Z is at least 1; wherein R', R'' is a $C_{1-20}$ alkyl or an amine group selected from cyclic amines, polyamines and alkylamines having from about 2 to about 7 carbon atoms in their alkyl chain, and wherein at least R' or R'' is an amine group; and wherein the curable amine functional silicone is cured in an emulsified form by heat and/or the addition of base to form an emulsified silicone gel.

A preferred silicone is when: R is a hydrogen or a $C_{1-3}$ alkyl; R' is $C_{1-3}$ alkyl; and R'' is an alkylamine group having from about 2 to about 7 carbon atoms in its alkyl chain; and wherein the curable amine functional silicone is cured in an emulsified form by heat and/or the addition of base to form an emulsified silicone gel.

The more preferred silicone is when: R is methyl; R' is methyl; R'' is $(CH_2)_3NH(CH_2)_2NH_2$; X is about 4; Y is about 27 and Z is about 2; wherein said silicone has a molecular weight in the range of from about 1,000 to about 2,800 and a viscosity of about 5-40 centistokes at 25° C.; and wherein the curable amine functional silicone is cured in an emulsified form by heat and/or the addition of base to form an emulsified silicone gel.

The physical properties of this system are vastly different than those of the starting polymer. The advantages of using the curable amine functional silicones for wrinkle reduction have been previously disclosed in U.S. Pat. Nos.: 4,800,026, Coffindaffer/-Wong, issued Jan. 24, 1989; 4,911,852, Coffindaffer/Trinh issued Mar. 27, 1990; and 4,923,623, Coffindaffer, issued May 8, 1990, all of said patents incorporated herein by reference, in which a polymer is delivered to the fabric and then permitted to cure by reacting with other silicones. Much to our surprise, if one cures the polymer to form a gel in the emulsion and then delivers the gel via a liquid vehicle, ease of ironing and improved appearance after ironing benefits can be achieved that are consumer noticeable.

The reaction time of producing the gel disclosed above can be decreased by increasing the pH of the emulsion. For example, at pH of 13, the gel of emulsified SF 1706 can be formed in 6 to 30 hours depending on the desired degree of cure before addition to product. An increase in temperature to ambient up to about 75° C. ±15° C. can also increase the rate of the curing reaction while a decrease in pH slows the curing reaction rate, e.g., at a pH of about 2.5, almost no curing takes place after one month at 23° C. Care should be taken to keep the temperature low enough so as to keep the emulsion intact.

In this reaction, the amine and base in the system act as the catalysts for the condensation curing reaction. The effectiveness of alkali metal hydroxides as catalysts increases in the order $Li^+ < Na^+ < K^+ < Rb^+ < Cs^+$. Many other methods which do not require the use of amines or bases for curing silicone polymers are well-known in the art, some of which are disclosed in the *Encyclopedia of Polymer Science and Engineering*, Vol.15, Second Edition, pages 204-308, John Wiley and Sons, Inc., 1989, and thus incorporated herein by reference.

One method of characterizing silicone gels is $^{29}Si$; NMR. Even in the emulsified form (with a relaxation aid such as $Cr(acac)_3$), M, D, T and Q are easily identified in the ranges specified above.

The fabric care composition of this invention comprises a suitable silicone gel and an aqueous carrier.

In preferred executions, the addition of from about 0.1% to about 33%, preferably from about 0.5% to about 20%, and, more preferably from about 1.0% to about 10% of the silicone gel by weight of the total aqueous starch composition can result in a product that provides outstanding ease of ironing and improved appearance after ironing benefits when fabric is rinse in or sprayed therewith in the usual manner. Another preferred execution is to spray an effective amount of an emulsified silicone gel on the freshly cleaned fabric or worn fabric.

Starch

The present invention is a liquid starch composition comprising an effective amount of silicone gel and up to about 99% liquid starch composition selected from conventional aqueous starch compositions. Such compositions contain from about 0.1% to about 35%, preferably from about 0.5% to about 20%, starch, a little surfactant, minors, and the balance water. Starch is employed to aid in ironing and sizing and to act as a carrier for the silicone gel component. Thus, any of the aqueous based starch compositions used in the fabric care art may be used herein. E.g., U.S. Pat. Nos. 4,780,499, Villarreal et al., issued Oct. 25, 1988; 3,644,241, Falivene, issued Feb., 1972; 3,833,393, Kandathil, issued Sept., 1974; and 4,495,226, Smith, issued Jan. 22, 1985; incorporated herein by reference in their entirety, disclose suitable starch and starch derivative compositions.

The amount of aqueous carrier included in the compositions of the present invention can vary depending upon the execution used and the type of composition to be formulated.

Preferred carriers are liquids selected from the group consisting of water and mixtures of the water and short chain $C_1$–$C_4$ monohydric alcohols. The water which is used can be distilled, deionized, or tap water. Mixtures of water and up to about 10%, preferably less than about 5%, of a short chain alcohol such as ethanol, propanol, isopropanol or butanol, and mixtures thereof, are also useful as the carrier liquid.

The carrier comprises from about 10% to about 98% by weight of the composition, and most preferably from about 60% to about 90% by weight of the starch/silicone gel composition.

The compositions of the present invention can be prepared by a number of methods. Some convenient and satisfactory methods ar disclosed in the following nonlimiting examples.

THE EXAMPLES

The emulsified silicone gel of the Examples is made from a specialty aqueous emulsion 124-7701 (defined hereinabove) made by General Electric Company. It contains 20% SF 1706 (defined hereinabove) and about 5% of a mixture of octylphenoxypolyethoxyethanol and alkylphenylpoly(oxyethylene)glycol emulsifiers. The emulsified silicone is then made into an emulsified gel by heating the emulsion at 120° F. (50° C.) for 7 days in a glass container.

EXAMPLE I

About 25 grams of emulsified silicone gel (25 parts) (20%) silicone gel) is added to 75 parts of a 2–3% starch composition (SPRAY 'N STARCH ® made by Texize, a division of Dow, Inc.) with stirring at ambient temperature. This mixture containing about 5% silicone gel is used as a pre-ironing spray-on for ease of ironing and improved appearance after ironing.

EXAMPLE II AND III

Two additional starch/silicone gel compositions are prepared as in Example I. About 5 parts and 50 parts of the 20% silicone gel emulsion are, respectively, mixed with the liquid SPRAY 'N STARCH compositions to provide, respectively, stable 1% and 10% silicone gel compositions.

The starch compositions are stable.

What is claimed is:

1. A liquid starch composition for treating fabrics, said composition comprising: (1) from about 0.1% to about 33% of a polymeric silicone gel, (2) from about 0.1% to about 35% of a laundry starch and (3) an aqueous carrier; wherein said silicone gel has is curable and from about 3% to about 30% T (tri-functional units) $R'SiO_{3/2}$ and/or Q (quat-functional units), $SiO_{4/2}$ from about 70% to about 97% D (di-functional units), $R'_2SiO_{2/2}$ and up to about 10% (mono-functional units), $(RO)R'_2SiO_{1/2}$ and a molecular weight of from about 20,000 to about 1,000,000.

2. The composition of claim 1 wherein the said silicone gel is made by emulsion polymerization.

3. The composition of claim 1 wherein the said silicone gel is made by emulsifying a silicone polymer and curing via crosslinking in the emulsion.

4. The composition of claim 1 wherein the said silicone gel is made by emulsifying a curable silicone polymer with catalyst and heating the emulsion to crosslinking in the emulsion.

5. The composition of claim 1 wherein the said silicone gel is made by emulsifying a curable silicone polymer with catalyst and heating the emulsion to crosslinking in the emulsion.

6. The composition of claim 5 where the curable silicone polymer is a branched curable amine functional silicone polymer and cured by heating.

7. The composition of claim 5 where the curable silicone polymer is a branched curable amine functional silicone polymer and base is used as the catalyst for curing at or above ambient temperature.

8. The composition of claim 1 wherein said carrier is selected from the group consisting of: water, weak aqueous surfactant solutions, lower molecular weight $C_1$-$C_4$ alcohols not to exceed 10%, and mixtures thereof.

9. The composition of claim 1 wherein said silicone gel is a concentrate wherein said concentrate is diluted for use.

10. The composition of claim 9 wherein said composition contains from about 0.5% to about 25% of said silicone gel and said carrier is water.

11. The composition of claim 10 wherein said concentrate contains from about 1% to about 10% of said silicone gel.

12. The composition of claim 1 wherein said silicone gel has a molecular weight greater than about 50,000.

13. The composition of claim 12 wherein said silicone gel has a molecular weight greater than about 100,000.

14. The composition of claim 1 wherein said silicone has from about 5% to about 20% T and/or Q functional units, from about 80% to about 95% D functional units, and from 0% to about 8% M functional units; and a molecular weight greater than about 100,000.

15. The composition of claim 14 wherein said silicone gel has a molecular weight greater than about 500,000.

16. The composition of claim 15 wherein said silicone gel has a molecular weight of about 1,000,000.

17. The composition of claim 1 wherein said silicone has from about 5% to about 15% T and/or Q functional units, from about 85% to about 95% D functional units, and from 0% to about 5% M functional units; and a molecular weight greater than about 100,000.

18. The composition of claim 17 wherein said silicone gel has a molecular weight greater than about 500,000.

19. The composition of claim 18 wherein said silicone gel has a molecular weight of about 1,000,000.

20. The composition of claim 1 wherein said silicone gel is made from a branched curable amine functional silicone having the following structure:

$$((RO)R'_2\,SiO_{1/2})_X\,(R'_2\,SiO_{3/2})_Z;$$

wherein

X is equal to Z+2; and

Y is at least 3; and wherein

Z is at least one;

wherein

R is a hydrogen or a $C_{1-3}$ alkyl;

R', R'' is a $C_{1-20}$ alkyl or an amine group selected from cyclic amines, polyamines and alkylamines having from about 2 to about 7 carbon atoms in their alkyl chain, and wherein at least R' or R'' is an amine group; and wherein the curable amine functional silicone is cured in an emulsified form to an emulsified silicone gel.

21. The fabric care composition of claim 20 wherein

R' is $C_{1-3}$ alkyl; and

R'' is an alkylamine group having from about 2 to about 7 carbon atoms in its alkyl chain; and wherein the curable amine functional silicone is cured in an emulsified form by heat and/or the addition of base to form an emulsified silicone gel.

22. The composition of claim 21 wherein said R is methyl; R' is methyl and R'' is $(CH_2)_3NH(CH_2)_2NH_2$; and X is about 3.5; Y is about 27 and Z is about 2; wherein said silicone has a molecular weight in the range of from about 1,000 to about 2,800 and a viscosity of about 5–40 centistokes at 25° C.; and wherein the curable amine functional silicone is cured in an emulsified form by heat and/or the addition of base to form an emulsified silicone gel.

23. A method of making ironing easier and improving the appearance of the garment after ironing comprising: applying to said garments in an effective amount of the liquid starch composition of claim 1.

24. The method of claim 23 wherein the silicone gel is present in said liquid starch composition at a level of from about 0.5% to about 20% by weight of said liquid starch composition.

25. The method of claim 24 wherein said silicone gel is present at a level of from about 1% to about 10% by weight.

* * * * *